US006151961A

United States Patent [19]

Huber et al.

[11] Patent Number: 6,151,961

[45] Date of Patent: Nov. 28, 2000

[54] DOWNHOLE DEPTH CORRELATION

[75] Inventors: Klaus B. Huber, Sugar Land; Steven W. Henderson, Katy, both of Tex.; James W. Babineau, Newton, Mass.

[73] Assignee: Schlumberger Technology Corporation, Sugar Land, Tex.

[21] Appl. No.: 09/264,391

[22] Filed: Mar. 8, 1999

[51] Int. Cl.[7] ..... E21B 47/00; G01B 1/00

[52] U.S. Cl. ..... 73/152.54; 166/250.01; 33/544

[58] Field of Search ..... 73/152.54, 152.03; 33/544, 302; 166/250.01, 373; 250/256, 269.5; 340/854.9; 175/24; 367/33; 702/8, 6

[56] References Cited

U.S. PATENT DOCUMENTS 4,697,650 10/1987 Fontenot .
5,581,024 12/1996 Meyer, Jr. et al. .

OTHER PUBLICATIONS

Wheeler et al., "Completion Technology: New Slickline Tool Simplifies Rigless Completions", (no date).

*Primary Examiner*—Hezron Williams
*Assistant Examiner*—Jay L. Politzer
*Attorney, Agent, or Firm*—Fish & Richardson P.C.

[57] ABSTRACT

A tool for initiating a downhole function in a subsurface well, such as a cased well. The tool has memory adapted to store a well-specific reference pattern of one or more downhole well characteristics as a function of position along the well, one or more sensors responsive to the downhole well characteristics, and a clocked processor. The processor is adapted to receive well characteristic signals from the sensors, determine, from the signals and the reference pattern in memory, the position of the tool along the well, and automatically initiate a downhole function at a preprogrammed position along the well while the tool is moved at a substantially constant rate along the well. The tool may be configured in a string of tools for performing multiple downhole functions. In some embodiments the reference pattern is the known spacing of discrete downhole features, such as casing collars. In some other embodiments the reference pattern is a log of a geophysical parameter, such as a natural gamma log. Methods of use are also disclosed.

36 Claims, 9 Drawing Sheets

| | SPACING ARRAY |
|---|---|
| $r_1$ | 1.0000 |
| $r_2$ | 0.9870 |
| $r_3$ | 1.0135 |
| $r_4$ | 1.1260 |
| $r_5$ | 0.9934 |
| ⋮ | |
| $r_n$ | |

DOWNHOLE DEPTH CORRELATION

BACKGROUND OF THE INVENTION

This invention relates to tools for initiating downhole functions in a cased well at a predetermined position along the well, and methods of using such tools.

In performing operations within a cased well, such as perforating the casing at a desired depth as part of a well completion, it is important to know the exact location of the tool lowered into the well to perform the specified function. In wireline or slick line operations, the depth of the tool string is commonly determined by passing the cable over a calibrated measurement wheel at the surface of the well. As the tool is deployed, the length of cable unspooled into the well is monitored as an estimate of tool depth. Depth compensation for cable stretch may be attempted by calculating a theoretical stretch ratio based upon cable length, elasticity and tool weight. Even with very elaborate compensation algorithms, however, the actual amount of cable stretch may vary over time and because of unforeseen and unmeasured interactions between the cable and tool string and the well bore (such as tool hang-ups and cable friction) and anomalies such as cable "bounce". Deviated wells, in which the tool is pulled along the interior surface of the well casing, can present particular problems with variable and inconsistent cable loading, as the tool "sticks" and jumps along the well bore. Such problems are also encountered, albeit to a lesser degree, in tubing-conveyed operations in which tubing length is measured by a wheel arranged to roll along the tubing as it is unspooled. Even very small deployment length measurement error percentages and other discrepancies can result, with either type of deployment, in absolute tool positioning errors of several feet or more in a well of over a mile in depth, for example.

To more accurately position a tool with respect to a particular geologic formation, a combination log is sometimes prepared of a cased well prior to lowering the tool. The combination log is a correlation of two simultaneously prepared logs of a given well bore. For example, a combination log may be prepared of a geophysical parameter, such as natural gamma radiation, alongside a log of casing collars (as sensed with a casing magnetic property sensor). Such a log is sometimes called a Combined Collar Log, or CCL. The combination log is prepared by shifting the depth of one log by the fixed interval between the sensors on the logging tool to correlate the logs to a common depth reference. The usefulness of such a combination log is enhanced by the irregularity of collar spacings along the well, determined by uneven casing section lengths. After the combination log is prepared, a completion tool string equipped with a collar sensor is lowered into the well. Collar "hits" are telemetried back to an operator at the well surface as the cable is retrieved and marked every three feet or so, and the tool operator attempts to match the pattern of hits with the pattern of collars in the CCL. Matching the irregular pattern to associate a given collar "hit" with a particular collar of the CCL by visually over-laying the logs, and aided by an approximate depth indication from the cable wheel, the operator determines the exact position of the tool string with respect to the CCL, and then initiates the intended function of the tool. It is not necessary that the exact depth of the tool be determined, per se, as correlation with the CCL positions the tool relative to the geologic formation as required for optimal tool function (e.g., perforation). Although this procedure provides a more accurate positioning of the tool string with respect to the formation, it requires the direct involvement of a knowledgeable operator and must allow for both data telemetry to the well surface and remote activation of the tool string.

As oil deposits become more scarce, more accurate means of positioning tools for perforating wells for optimal recovery become increasingly important.

SUMMARY OF THE INVENTION

This invention can provide enhanced positioning of downhole tools with respect to geologic formations of interest, without requiring data telemetry for correlation. In addition, the invention can enable the automated operation of downhole tools for performing remote functions in a cased well at predetermined, precise positions along the well, without requiring communication between the tool and the surface of the well for such things as data correlation and function activation.

The invention features a tool for initiating a downhole function in a subsurface well.

According to one aspect of the invention, the tool includes memory adapted to store a well-specific reference pattern of a downhole well characteristic as a function of position along the well, a sensor responsive to the downhole well characteristic, and a clocked processor. The clocked processor is adapted to receive a well characteristic signal from the sensor, determine, from the signal and the reference pattern in memory, the position of the tool along the well, and to automatically initiate a downhole function at a preprogrammed position along the well while the tool is moved at a substantially constant rate along the well.

By "automatically" we mean without requiring any triggering signals to be sent from the surface to initiate the downhole function. The processor begins processing data, in some embodiments, in response to receiving a signal from the surface of the well, but then completes its processing and automatically initiates the downhole function without requiring any further input from the tool operator.

In some applications in which the reference pattern comprises a sequence of irregular spacings between distinct downhole features (such as casing joints or casing magnetic property variations, for examples), the sensor is responsive to the proximity of each of the features to the sensor.

For some such applications, the processor is further adapted to determine the rate of motion of the tool along the well, and to advantageously initiate the downhole function at a preprogrammed position between adjacent features.

Some tools according to the invention have first and second sensors, spaced apart along the tool by a fixed longitudinal distance. The clocked processor is adapted to receive signals from both sensors and to determine, from the signals and the reference pattern in memory, the position and velocity of the tool along the well.

In some embodiments for use in a cased well with a characteristic pattern of downhole features having an average spacing, the longitudinal distance between the first and second sensors of the tool is significantly less than the average spacing of the downhole features, and the tool also has a third sensor. The third sensor is responsive to the proximity of the downhole features, and is spaced from the first and second sensors by a fixed longitudinal distance approximately equal to the average spacing of the downhole features.

Preferably, the tool housing in which the first and second sensors are mounted is of a material having a thermal expansion coefficient of less than about 4 micrometer per meter-degree Kelvin at about 465 degrees Kelvin (less than about 15 micrometer per meter-degree Kelvin at about 465 degrees Kelvin for essentially non-magnetic materials) and extending along substantially the entire longitudinal distance between the sensors. This can help to reduce undesirable error from thermally induced changes in sensor spacing.

Alternatively, in some embodiments the tool has a temperature sensor mounted to be responsive to the temperature of the housing material. The processor is adapted to automatically compensate for changes in the longitudinal distance between the two sensors caused by housing material temperature variations, enabling the use of housing materials with higher thermal expansion coefficients, such as carbon steels.

In some cases the reference pattern comprises geophysical log measurement data.

In some embodiments, the processor is adapted to store a log of the signal received from the sensor, and to compare the signal log to the reference pattern to determine the position of the tool along the well. Such a tool may also have a casing joint sensor.

Some embodiments also have a pressure sensor responsive to hydrostatic well pressure, and are adapted to enable the initiation in response to well pressure. For various applications, the tool may be adapted to either disallow the initiation below a preset threshold pressure, or to enable the initiation upon sensing a predetermined sequence of well pressure conditions.

In some embodiments the tool is adapted to be lowered into the well on tubing. In such cases, the tool includes a first pressure sensor responsive to hydrostatic well pressure (i.e., pressure within the well at the outside of the tool); and a second pressure sensor responsive to hydrostatic tubing pressure (i.e., pressure within the tubing). The tool is adapted to enable the initiation in response to a combined function of well and tubing pressures.

For various applications, the tool may be adapted to either disallow the initiation below a preset threshold difference between well and tubing pressures, or to enable the initiation upon sensing a predetermined sequence of relative variations in well and tubing pressures.

In some embodiments, the tool is adapted to be moved along the well on a slick line.

Some embodiments of the tool include a shot detector responsive to a ballistic detonation within the well, the tool being adapted to disallow the initiation until a ballistic detonation is detected by the shot detector.

In some cases, the clocked processor is adapted to begin comparing the signal and reference pattern in response to a sensed downhole event, such as receipt of a signal transmitted from the surface of the well. The type of signal transmitted from the surface of the well may be hydraulic pressure, electric, and acoustic, for instance.

In some applications, the sensed downhole event comprises maintaining the tool in a stationary downhole position for a predetermined length of time, or contacting a downhole well surface, or a predetermined pattern of tool motions.

According to another aspect of the invention, a tool string is provided for performing a series of downhole functions in a subsurface well. The string includes a first tool configured to perform a downhole function, and a second tool having a function detector responsive to the performance of the function of the first tool. Each of the first and second tools include memory adapted to store a well-specific reference pattern of a downhole well characteristic as a function of position along the well, a sensor responsive to the downhole well characteristic, and a clocked processor. The processor is adapted to receive a well characteristic signal from the sensor, determine, from the signal and the reference pattern in memory, the position of the tool along the well, and to automatically initiate a downhole function at a preprogrammed position along the well while the tool is moved at a substantially constant rate along the well. The second tool is advantageously adapted to disallow the initiation of the second tool until the performance of the first tool is detected by the function detector of the second tool.

In some embodiments, the first tool is arranged to detonate a first ballistic device, and the function detector of the second tool comprises a shot detector responsive to the detonation of the first ballistic device.

Various embodiments of the tools of the tool string have one or more features discussed above with respect to the first listed aspect of the invention.

According to another aspect of the invention, a method of initiating a downhole function in a subsurface well is provided. The method includes the steps of:

(1) lowering the above-described tool into the well; and (2) moving the tool at a substantially constant rate along the well until the clocked processor has determined the position of the tool along the well and automatically initiated the downhole function.

In some instances the method includes, prior to lowering the tool into the well, downloading the well-specific reference pattern into the tool memory.

In some situations in which the subsurface well is cased and the downhole features comprise casing collars, the method also includes correlating the sequence of irregular spacings between casing collars to a well-specific log of geophysical measurement data, and then downloading the sequence of spacings between casing collars into the tool memory.

In some embodiments, the reference pattern comprises geophysical log measurement data, and the processor is adapted to store a log of the signal received from the sensor and to compare the signal log to the reference pattern to determine the position of the tool along the well.

In some embodiments the method includes, after lowering the tool into the well, causing a downhole event that prompts the clocked processor to begin comparing the signal and reference pattern.

In some embodiments, after the downhole function has been initiated, the tool is retrieved from the well and configured for a subsequent operation.

In some embodiments, the tool has first and second sensors, spaced apart along the tool by a fixed longitudinal distance. The clocked processor is adapted to receive signals from both sensors and to determine, from the signals and the reference pattern in memory, the position and velocity of the tool along the well. In some cases, the tool also includes a temperature sensor mounted to be responsive to the temperature of the housing material extending between the sensors. Temperature signals received from the temperature sensor enable the clocked processor to automatically compensate for changes in the longitudinal distance between the two sensors caused by housing material temperature variations.

This invention can provide several advantages for well bore operations in which accurate location of tools along a subsurface well (e.g., a cased well) is desired. By correlating reference well logs within the tool's memory with sensor signals, for instance, the tool can "find" a preprogrammed depth (or position along the well) and begin a preset sequence of operations without further input from the tool operator at surface. Furthermore, the tool can be configured to require sensing a particular downhole event (e.g., an event expected to occur during a well completion or test) before either beginning its depth determination calculations or initiating its preset function.

These capabilities can result in particularly advantageous improvements in downhole tool operation. In well completions, for example, perforation guns may be placed to optimally penetrate very narrow pay zones or to perforate the casing at the proper location for either maximum flow or maximum recovery. Substantially "rigless" completions may therefore be enabled by the invention, allowing pre-programmed slickline operation of the tool string by less sophisticated crews. Underbalanced perforating, in which the completion tools are retrieved with the well head under elevated pressure conditions, is particularly facilitated by automated tool operation and slickline deployment, which expedites tool retrieval via sealed lubricators. Tools as described herein may also be lowered down a producing well to reperforate the well, without first killing the well.

The invention is also applicable to other downhole operations, such as the precise location of tools in rescue or repair operations, in which stranded tools or damaged casing sections must be precisely located in order to save the well.

Other features and advantages will be apparent from the following description and claims.

DESCRIPTION OF EMBODIMENTS

Figure 1:
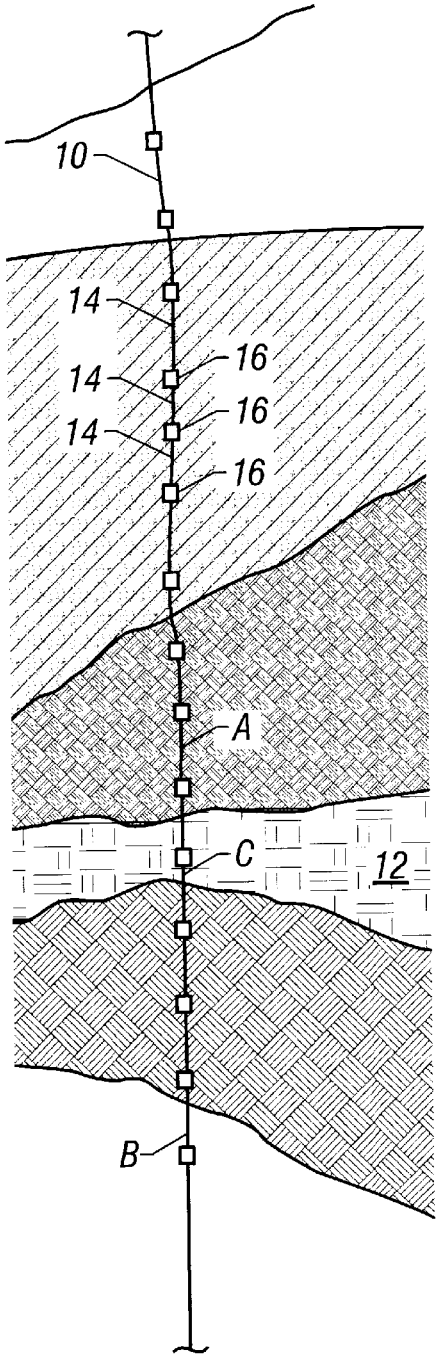
FIG. 1 is illustrates a pattern of casing collars along a well bore, and surrounding geology.

Referring to FIG. 1, a cased well 10 is illustrated as a line extending through geologic formation strata including a narrow layer of oil-bearing shale 12 as determined by known logging and exploration techniques. The casing of the well is a series of casing sections 14 joined at threaded collars 16, as is typical of cased wells. Casing sections 14 are each about 30 feet long, plus or minus about two feet. The distance between adjacent collars 16, therefore, varies along the length of the well. This length variance results in a well-specific pattern of collar spacings along the well.

Figure 2A:
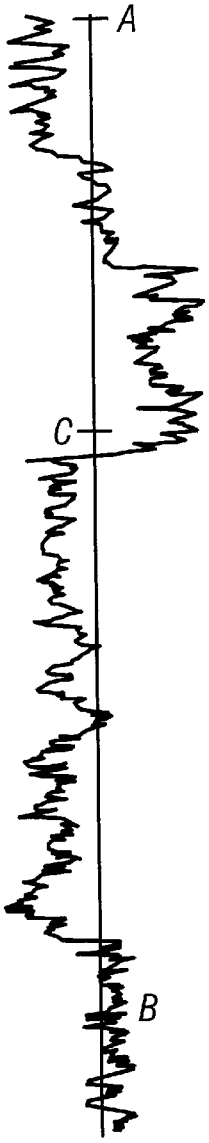
FIGS. 2A and 2B show correlated natural gamma and collar location logs of the well over an interval between A and B.

For purposes of illustration, let point C be the position at which it has been determined the well should be perforated for optimal product recovery from shale 12. After the well has been cased, a combination logging tool is lowered into the well, as known in the art, and moved upward along the well from point B to point A to produce a CCL of a geophysical parameter (such as a natural gamma log as shown in FIG. 2A, for instance) and collar location (as in FIG. 2B). The geophysical property log may be compared to a log taken of the pre-cased well to correlate the CCL to the geologic formation, and the CCL pulses 18*a* through 18*f* representing collar "hits" (FIG. 2B) are readily correlated to the geophysical property log by knowing the fixed distance between the effective measurement points of the two types of sensors along the logging tool, as known in the art. The positions of points A, B and C can thus be established on the logs of FIGS. 2A and 2B, and the two logs overlaid to produce a CCL.

Figure 3:
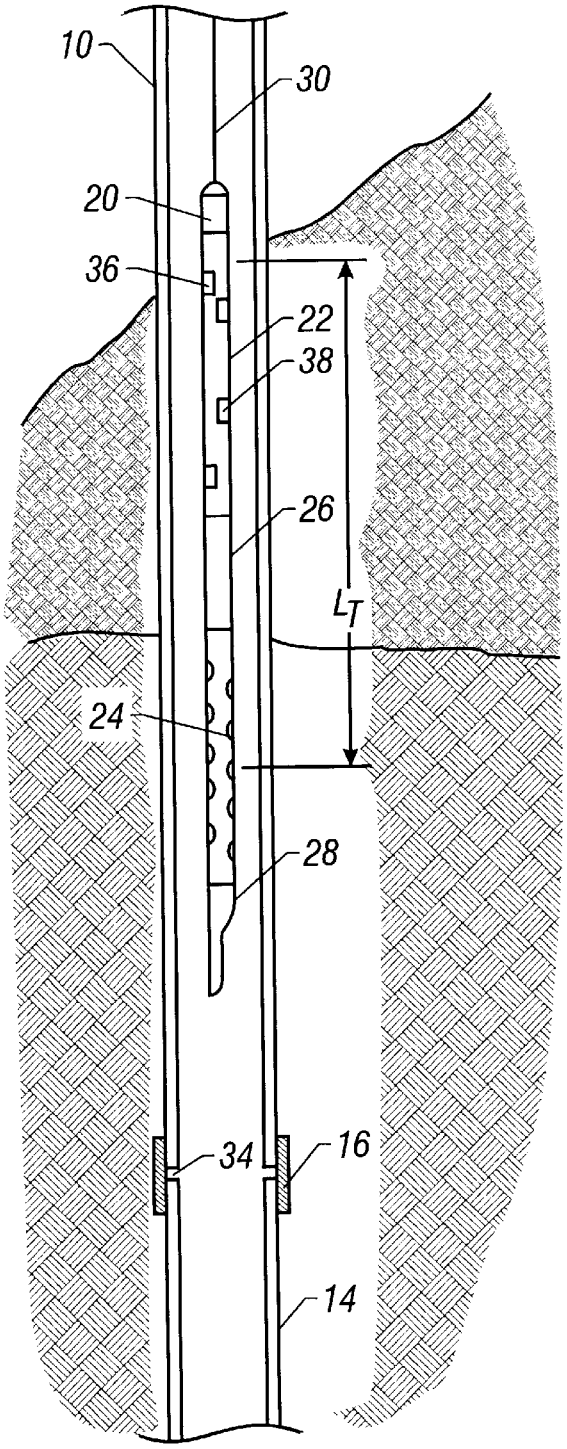
FIG. 3 shows a string of tools being moved along the well near a casing collar.

Referring to FIG. 3, a tool string 20 includes an automated firing head 22 and a perforating gun 24, separated by a ballistic transfer spacer 26. At the lower end of the tool string is an eccentric weight 28 as used in deviated wells. Tool string 20 is lowered into well 10 on a standard slick line 30 having no electrical conductors or hydraulic tubing for communicating between the tool string and the operator at the surface of the well. A casing collar 16 is also shown, threadably connecting two adjacent casing sections 14 with a gap 34 defined between the facing ends of the casing sections.

Firing head 22 is constructed and programmed to automatically detonate gun 24 at a predetermined position along the well, without any detonation command or signal received from the completions operator, as explained below. In one embodiment, firing head 22 has a single collar sensor 36 and a well pressure sensor 38. The firing head is disabled until a predetermined hydrostatic pressure level has been sensed by the pressure sensor, at which point it begins to search for a recognizable pattern of collar spacings as tool string 20 is moved along the well at as constant a rate as is practically possible by maintaining a constant cable retrieval speed at the well surface. Every time collar sensor 36 passes a collar 16, the firing head registers a collar "hit".

Figure 2B:
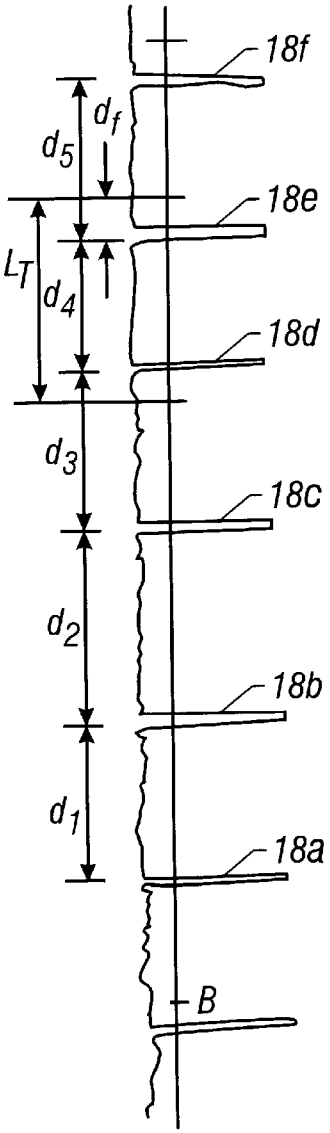
Figure 4:
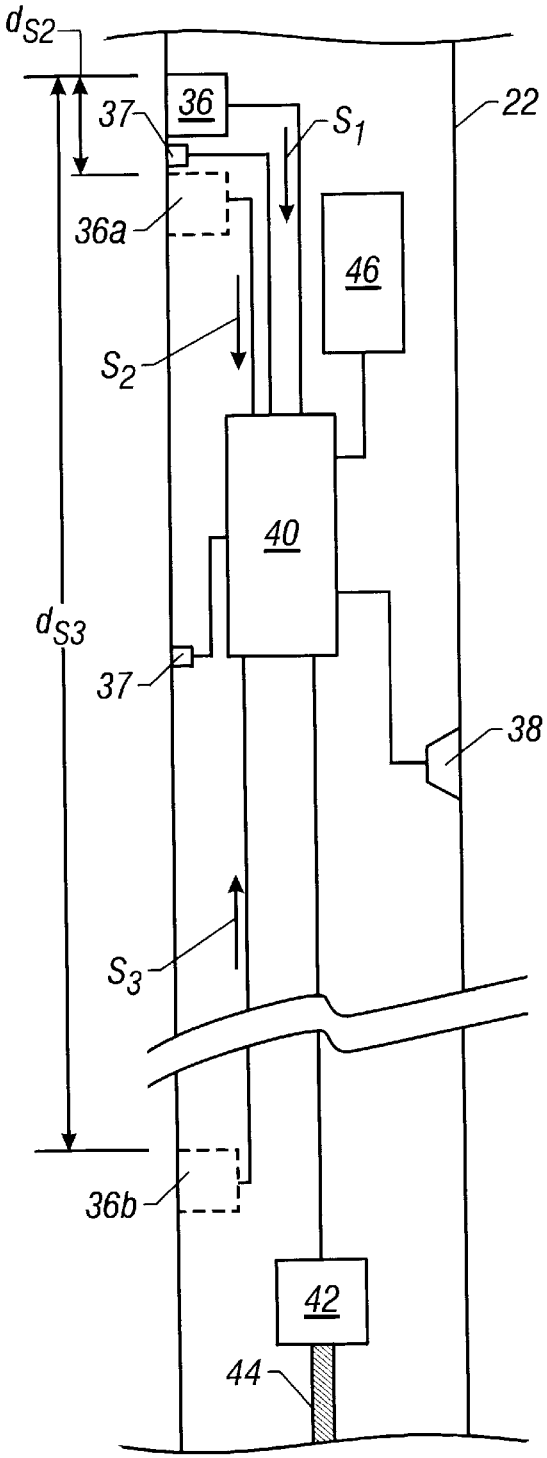
FIG. 4 graphically illustrates the functional architecture of the automated firing head of the tool string of FIG. 3.
Figures 5A, 5B:
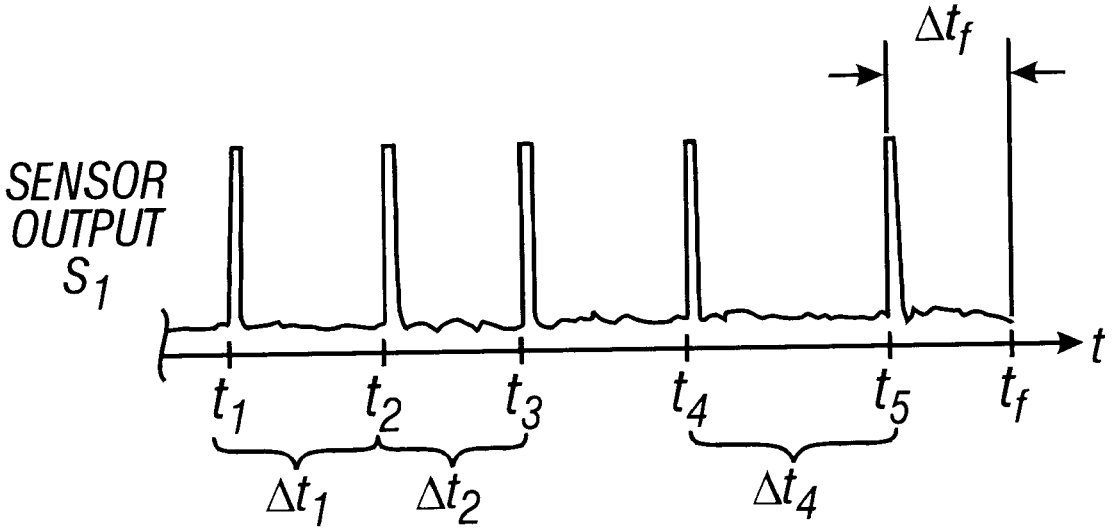
FIG. 5A illustrates another example of a collar spacing reference pattern.
FIG. 5B shows the collar sensor output as a function of time as the tool is moved upward at a constant rate from point B in FIG. 1.

Referring to FIG. 4, firing head 22 contains a programmable processor 40 adapted to receive signals from collar sensor 36 and pressure sensor 38, and to output a signal to activate an ignitor 42 to ignite a length of primacord 44 to detonate its associated gun (24, FIG. 3). Other firing head embodiments, discussed below, contain additional collar sensors (e.g., 36*a* and 36*b*, illustrated in dashed outline). Prior to running the firing head into the well, the well-specific collar log for the interval of interest (e.g., interval A–B as in FIG. 2B) is stored in memory 46, accessible by processor 40. Although the memory is illustrated as separate from the processor, FIG. 4 should be understood to be a functional illustration and not implying that the memory need physically exist separate from the processor. Indeed, processors having sufficient internal memory for storing the required reference pattern of collar spacings (or other feature pattern or geophysical parameter pattern) may be employed. By "clocked", we mean that processor 40 includes means for measuring the time between events, or that such time-measuring means is otherwise accessible by the processor, such that the processor is adapted to determine the time between events. As the firing head is run into the well, memory 46 contains a reference pattern of collar spacings specific to the depth interval in which the perforating gun is to be detonated. This reference pattern may be in the form of a downloaded collar log trace as shown in FIG. 2B, or in the form of a sequence of collar spacing ratios $r_1$ through $r_5$, as shown in FIG. 5A. The first spacing ratio $r_1$ of the array of FIG. 5A is unity (i.e., 1.0000), corresponding to the nominalized length of spacing $d_1$ between first and second collars (FIG. 2B) of the well interval, and each subsequent ratio $r_2$ through $r_n$ is the ratio of the next collar spacing to the one previous. Thus the data shown in FIG. 5A indicates that spacing $d_2$ is 98.7% of spacing $d_1$, spacing $d_3$ is 101.35% of spacing $d_2$, et cetera. Also stored in memory 46 is the fixed distance $L_T$ between the collar sensor and the middle of the perforating gun (FIG. 3), which determines the position D of the collar sensor at the point where the gun is to be detonated (FIG. 2B).

The tool string containing the preprogrammed firing head is preferably pulled upward toward the desired gun detonation point, especially in a deviated well, as pulling tools upward tends to result in fewer significant tool velocity variations than lowering tools downward by gravity. Over fairly vertical intervals or when detonating immediately above a bridge plug or other obstruction, however, a short tool string may be lowered toward its activation point. The pattern recognition algorithm, discussed below, is simplified if the direction of tool motion is known in advance. If the tool string is to be lowered to fire, the downloaded pattern should contain data for a significant interval of the portion of the well immediately above the desired activation point. If the tool string is to be raised, the reference pattern for the interval below the activation point should be stored. In any case, the stored data should include the pattern for that interval of the well traversed by the sensor (e.g., collar sensor 36) just prior to the tool string reaching its position for optimal functioning (e.g., with a detonating gun aligned with a desired perforation zone). A predetermined pressure threshold, corresponding to the well pressure near where the firing head is to begin attempting to match the reference pattern, is also stored in memory (46, FIG. 4).

For purposes of illustration, assume that the tool string is to be raised along the well interval from which the reference collar location pattern of FIG. 2B was taken, and that the reference pattern stored in memory is in the form illustrated in FIG. 5A. As the firing head (22, FIG. 3) is moved upward from point B, the signal $S_1$ of the collar sensor (36, FIG. 4) to the processor (40, FIG. 4) produces a pulse as the sensor passes each collar, as shown in the time-based signal trace of FIG. 5B. Thus, the pulse at time $t_1$ corresponds to collar hit 18*a* of the reference pattern (FIG. 2B), the pulse at time $t_2$ to collar hit 18*b*, et cetera, although this correspondence is not immediately determined by the processor as the first collars of the interval are traversed.

Figure 6:
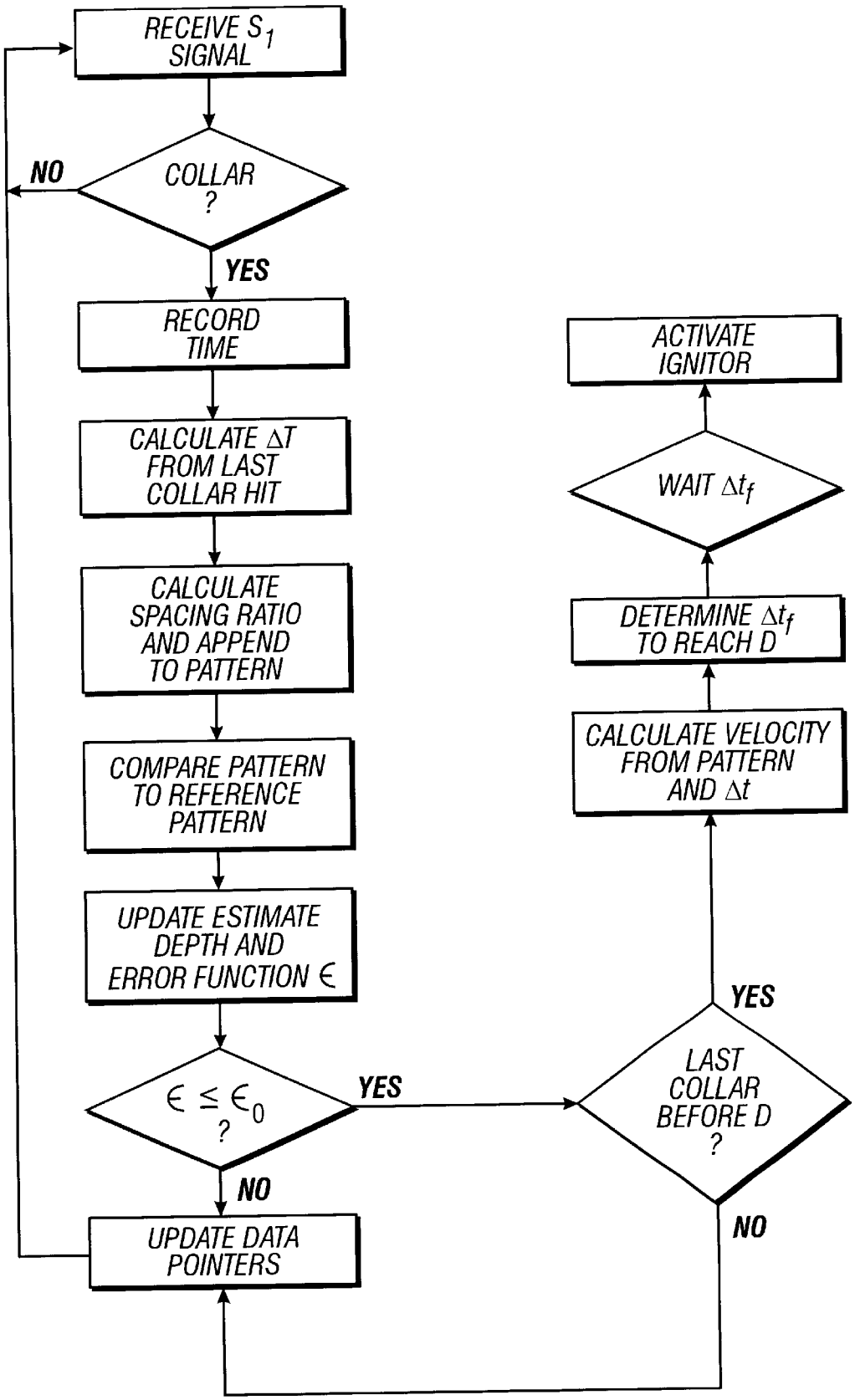
FIGS. 6 and 7 are flow diagrams for the automated function of the firing head processor in a tool employing one and two collar sensors, respectively.

FIG. 6 functionally illustrates the algorithm the processor is adapted to implement to determine the position of the tool string with respect to the desired activation position in order to activate the primacord ignitor (44, FIG. 4) at the proper moment as the firing head is moved along the well. The algorithm of FIG. 6 assumes a substantially constant tool velocity. The processor (40, FIG. 4), after determining from the signal from the pressure sensor (38, FIG. 4) that the well pressure at the firing head has reached the preprogrammed pressure threshold, begins to process signal $S_1$ from the collar sensor (36, FIG. 4). When the clocked processor recognizes a leading edge of a pulse of signal $S_1$, indicating the arrival of the collar sensor at a collar gap (34, FIG. 3), it records the time reading of its internal clock. Thus, the time recorded for the first collar passed in this illustration would be $t_1$ (FIG. 5B). As the collar sensor passes the second collar, the processor records arrival time $t_2$, and calculates and records time interval $\Delta t_1$ as the time between the first two collar 'hits'. After repeating this sequence to calculate and record $\Delta t_2$ as the time between the second and third collar "hits", the processor computes the ratio $\Delta t_1/\Delta t_2$ and records this ratio as the second entry in an array representing the sensed pattern of collar spacings. This ratio of $\Delta t_1/\Delta t_2$ is compared to each entry in the reference array (in this illustration, the data in FIG. 5A) to determine the most probable tool location along the interval. For instance, if the ratio $\Delta t_1/\Delta t_2$ were 1.0410 the processor would conclude (based upon standard data comparison methods) that the collar interval just passed corresponded to reference entry $r_3$ (FIG. 5A), and therefore that the first and second collars passed correspond to pulses 18*c* and 18*d*, respectively, of FIG. 2B. The processor records this conclusion and calculates an error function $\in$ which represents the uncertainty of the estimated tool string position. This uncertainty may be determined by any appropriate conventional mathematical formulation, but the error function should take into account the number of collar spacings calculated (i.e., the length of the array of sensed spacings) and the overall "fit" of the sequence of spacings to the reference pattern. If the calculated error function $\in$ is less than a predetermined value $\in_0$, the algorithm branches as an indication that the tool string position has correctly been determined. If the error function is too high, additional collar spacings are recorded until the error function diminishes. It should be noted that the more variability between individual sections of casing over the interval of interest, the more readily the automated firing head will determine its location. It is recommended, therefore, that casing sections of irregular length (e.g., of less than 80% of the average section length, or of greater than 120% of the average section length) be interspersed along the interval, especially if tool location must be determined over a short series of collars (i.e., less than 5 or 6).

Once the location has been determined (i.e., once error function $\in$ is less than $\in_0$) and the firing head identifies the last collar traversed as the last one to be passed before detonating its associated gun (for example, the collar corresponding to 18*e* in FIG. 2B), the processor calculates a nominalized tool velocity from the last spacing ratio (e.g., $r_4$ of FIG. 5A) and the last time interval (e.g., $\Delta t_4$ of FIG. 5B). From this nominalized velocity, the next reference spacing ratio (e.g., $r_5$ of FIG. 5A) and the location of the desired detonation position within that spacing ratio (e.g., $d_f/d_5$, FIG. 2B), the processor determines the amount of time $\Delta t_f$ it will take (FIG. 5B), assuming the calculated tool velocity is maintained, to place the perforating gun at point C (FIG. 1). At this point in the algorithm the firing head is essentially armed, and will detonate the gun at time $t_f$ (FIG. 5B) without further consideration.

In another embodiment, firing head 22 contains an additional collar sensor (36*a*, FIG. 4), with the processor 40 adapted to receive and process signals from both collar sensors. Preferably, sensors 36 and 36*a* are spaced relatively close together along the length of the firing head (i.e., separated by a short distance $d_{s2}$, FIG. 4), such that the time increment between the arrival of a collar at the two sensors will be relatively short. The material separating the two sensors (e.g., the section of the tool housing in which they are both mounted) should be constructed of a material with a very low thermal expansion coefficient, such as MONEL (for non-magnetic materials, such as for mounting magnetic reluctance sensors) or INVAR (for magnetic materials), in order to minimize any change in spacing between the sensors as a function of temperature. Preferred materials have thermal expansion coefficients below about 4 micrometer per meter-degree Kelvin at about 465 degrees Kelvin (380 degrees Fahrenheit), or below about 15 micrometer per meter-degree Kelvin at about 465 degrees Kelvin in the case of non-magnetic materials.

Figure 7:
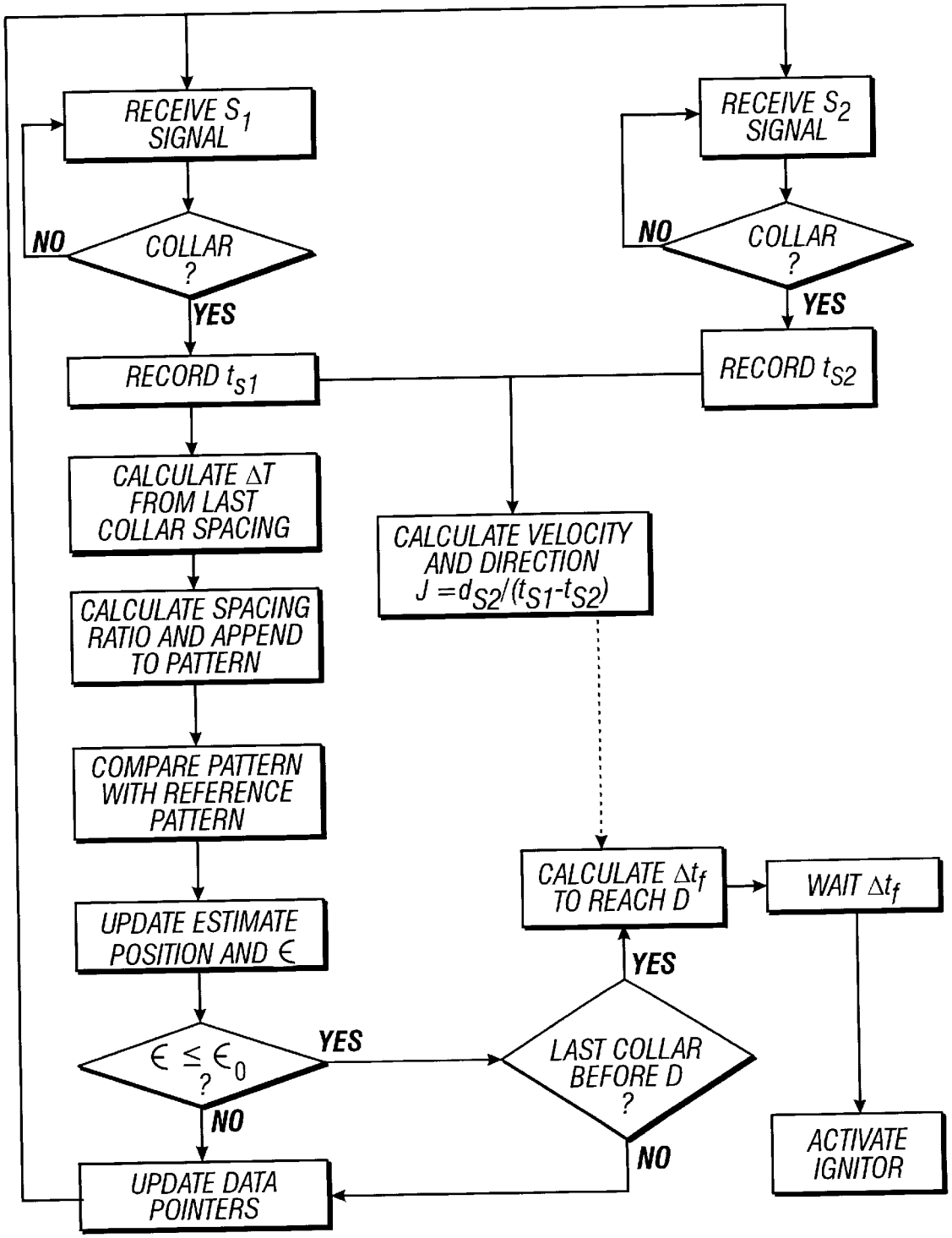

Referring to FIG. 7, from the dual signals $S_1$ and $S_2$ the processor calculates instantaneous tool velocity, v, as the ratio of the distance $d_{s2}$ between the sensors to the length of time $(t_{s1}-t_{s2})$ between adjacent hits as the pair of collar sensors passes a given collar. In some cases (not illustrated in FIG. 7) the processor can also use the second sensor signal $S_2$ to calculate a redundant spacing pattern for verification of the pattern established by signal $S_1$. The velocity v calculated from the dual sensor signals as the sensors pass each collar is compared to prior velocity calculations to determine the consistency of the tool string motion. The error function $\in$ in this case should also be a function of any sensed velocity variation. Using at least two collar sensors enables the determination, by the processor (40, FIG. 4), of the sense as well as of the magnitude of the tool velocity, allowing the firing head to automatically adapt to a change in tool movement direction. In the memory of a firing head having multiple, spaced apart sensors, the reference pattern is stored as an array of collar spacing measurements from the CCL, rather than as a series of spacing ratios, in order to simplify the pattern comparison algorithm. In addition, velocity may be calculated directly from sensed measurements and therefore need not be inferred from the reference pattern.

The more closely arranged the multiple collar sensors along the firing head, the more accurate the velocity determination and hence, the more precise the positioning of the gun for detonation. In addition, with multiple sensors tool velocity fluctuations may be more completely accounted for in the establishment of the sensed collar pattern. For the most accurate tool positioning, the tool string would include a series of closely-spaced collar sensors (or geophysical parameter sensors) extending over a length greater than the length of the longest casing section of the well interval. As the sensor array were moved along the well, a processor adapted to receive and simultaneously process signals from all sensors of the array would be able to calculate instantaneous tool velocity with a resolution comparable to that of the sensor spacing of the array.

Figure 8:
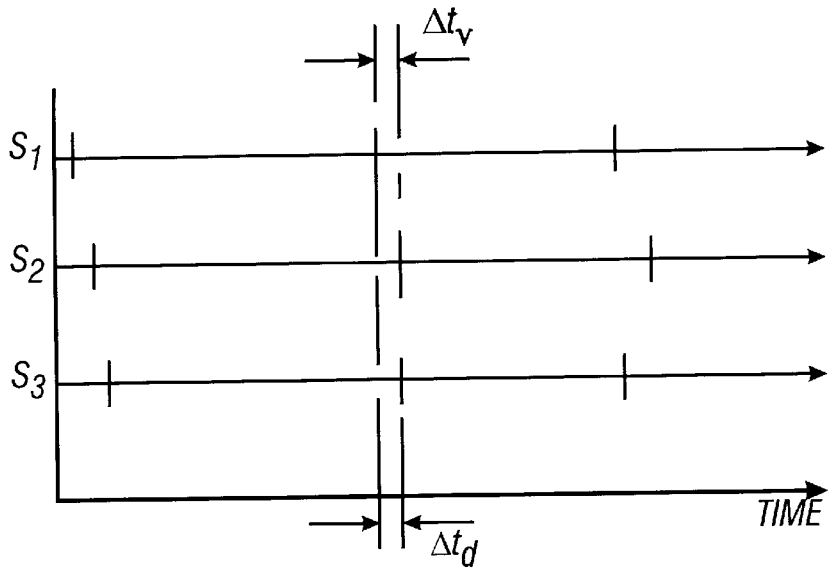
FIG. 8 shows time traces of signals received from three feature sensors mounted in a single tool.

Another embodiment of firing head 22 has three collar sensors arranged as shown in FIG. 4, with the third collar sensor 36*b* spaced a distance $d_{s3}$ from first sensor 36, with $d_{s3}$ substantially equal to the average length of the casing sections of the well interval. Thus, while the closely-spaced first and second sensors pass one collar, the third sensor is near an adjacent collar. The relative time-based output of the signals $S_1$, $S_2$ and $S_3$, corresponding to sensors 36, 36*a* and 36*b*, respectively, is shown in FIG. 8. Tool velocity is determined from the time delay $\Delta t_v$ between hits on $S_1$ and $S_2$ (FIG. 8) and the spacing $d_{s2}$ between sensors 36 and 36*a* (FIG. 4). This instantaneous velocity is then employed to determine, from the time delay $\Delta t_d$ between hits on $S_1$ and $S_3$ (FIG. 8) and the spacing $d_{s3}$ between sensors 36 and 36*b* (FIG. 4), the precise length of the casing section spanned at that moment by the sensor array. because the measurements of velocity and distance are made at very nearly the same time (due in part to the selection of sensor spacing $d_{s3}$), the effect of velocity variations (e.g., tool sticking and jumping) is greatly reduced.

As an alternative to employing materials with very low thermal expansion characteristics to minimize errors due to thermal fluctuations, sensors 36 and 36*a* (and, if employed, sensor 36*b*) may be separated with a material of higher thermal expansion characteristics (e.g., carbon steel) and one or more temperature sensors 37 mounted to sense the temperature of the material between the spaced-apart sensors. In this case, processor 40 is programmed to adjust its computations to take into account changes in the distances between the sensors, as determined from known thermal expansion properties of the inter-sensor material and sensed temperature. Such temperature sensing and adjustments are not necessary if changes in sensor separation due to changes in downhole temperatures are small enough to be ignored without adversely affecting the processor's ability to sufficiently recognize characteristic patterns from the sensor signals and determine its position along the well.

Although the above-described embodiments feature collar sensors, it should be understood that the firing head may instead be configured to sense any other fixed, repeating downhole well feature. For instance, the well casing may be provided with a built in series of markers identifiable by the tool string as it is moved along the well. These markers may be, for instance, magnetic, radioactive or chemical. Chemical and radioactive marking may optionally be performed after the well casing is in place. One of the advantages of the above-described method of sensing collars is that it does not require any special or novel casing construction and may therefore be employed to reperforate already existing wells.

Figure 9:
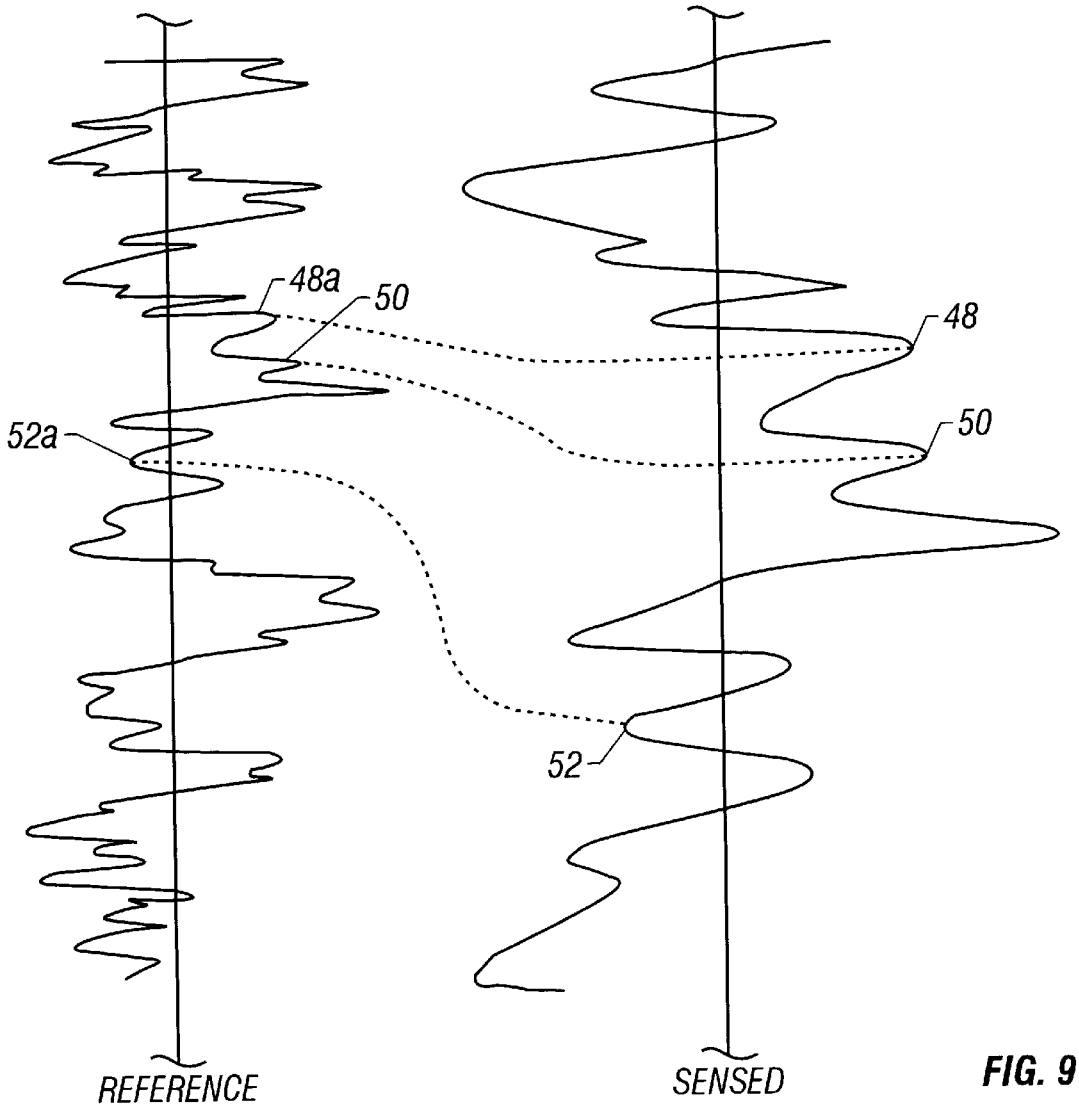
FIG. 9 illustrates the correlation between a reference pattern of a geophysical parameter and the parameter as sensed by a sensor of the tool string.

In another embodiment, the firing head is constructed as shown in FIG. 4, except that the sensors 36 (and, if included, sensors 36*a* and 36*b*) are adapted to sense a geophysical well parameter, such as natural gamma radiation, instead of a series of distinct features such as casing collars. In this approach, the original geophysical log data (e.g., the natural gamma log of FIG. 2A) is stored in memory 46 and used as the reference pattern for comparing a natural gamma log as sensed by sensor 36 as the tool string is moved along the well. The reference pattern, shown on the left in FIG. 9, may be stored as either a function of position along the well or, if the original logging tool were moved at a constant rate, as a function of time. Because the completion tool string and original logging tool may be moved at different velocities, even if the reference pattern were as a function of time the processor (40, FIG. 4) must be adapted to correlate the sensed pattern (on the right in FIG. 9) with the reference pattern. Data manipulation algorithms for performing such correlations are known in the art, although they are generally performed uphole after the data is collected. By programming the firing head to perform such algorithms downhole, while additional data is simultaneously collected, the firing head is able to identify from the pattern of data specific features (e.g., local maxima/minima 48, 50 and 52) with corresponding features (e.g., local maxima/minima 48*a*, 50*a* and 52*a*, respectively) of the reference pattern. From the relative spacing of such features, the processor determines the rate at which the tool is progressing along the reference pattern and the time at which it will arrive at the predetermined depth where it is to perform its function.

Employing such a continuous trace as a reference pattern, the accuracy of the automated position correlation of the downhole tools is theoretically limited only by the resolution between data points of the reference pattern as stored in digital form, by the response time of the sensor, and the speed of the processor. Also, once the processor has determined (within acceptable error limits) the position of the tool string with respect to the reference pattern, its velocity calculation may be updated continually and, if desired, recorded and processed to keep track of speed variability and to better predict the time of arrival at the depth of detonation. By monitoring the velocity history of the tool string, the processor may also be adapted to recognize a repeating pattern of velocity fluctuations, and thereby to predict and account for future fluctuations as it nears its detonation point. If desired, the firing head may be equipped with additional geophysical parameter sensors (e.g., 36*a* and 36*b*, FIG. 4) for redundant processing.

Figure 10:
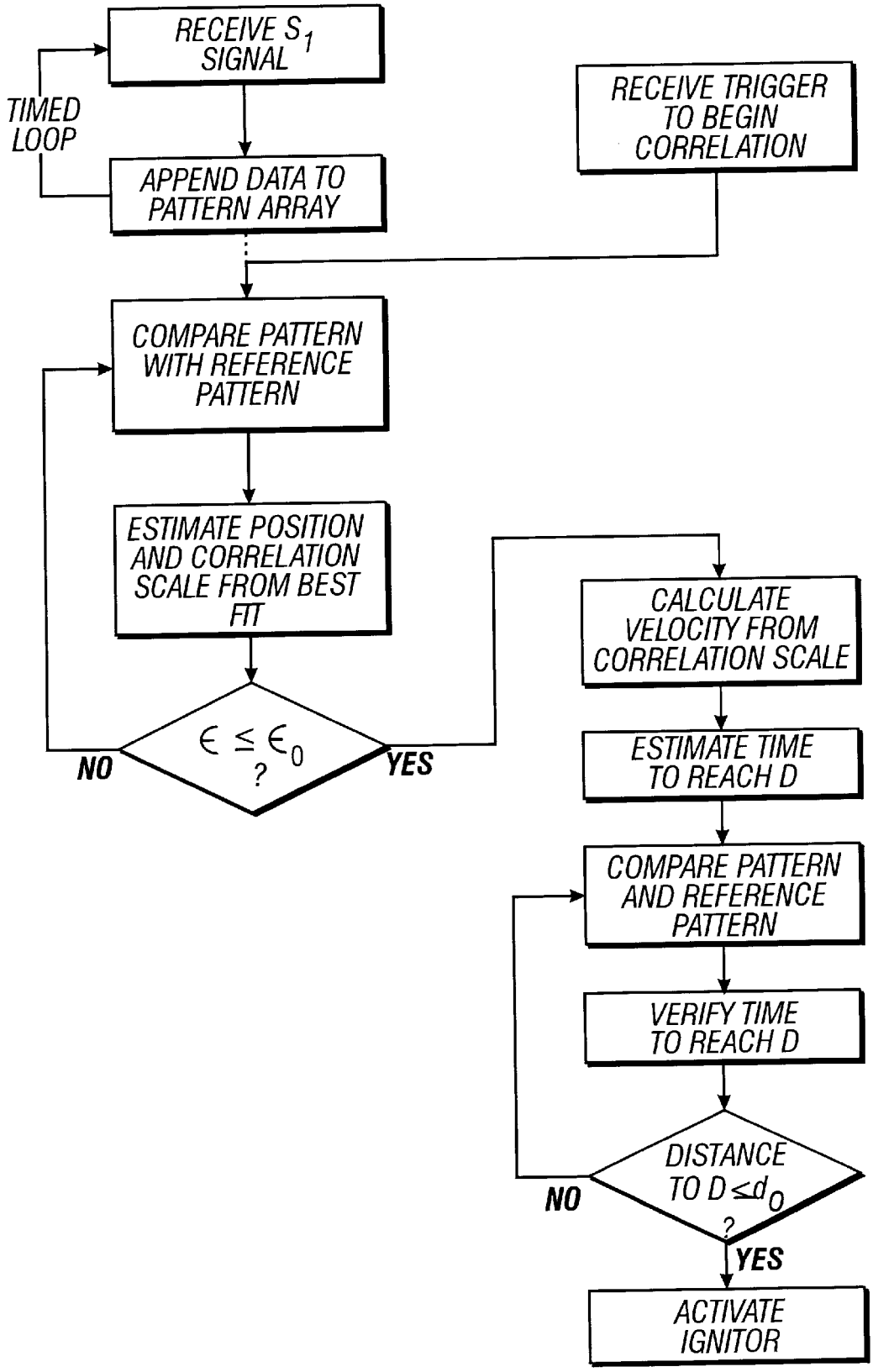
FIG. 10 is a flow diagram for the automated function of the firing head processor in a tool employing a geophysical parameter sensor.

FIG. 10 shows an example of a flow diagram of an algorithm for determining position and activating an ignitor, employing a continuous log of a geophysical parameter as the reference pattern. Initially, as the tool string is moved at a substantially constant velocity along the well, the processor may optionally receive and store sensor data and begin to develop a log of the signal from the sensor (as shown, for instance, on the right in FIG. 9). Or, the processor may be configured to wait to begin any data storage or processing until triggered to do so. When triggered to begin correlation, either by a signal from a pressure sensor (38, FIG. 4) as described above, or by a recognized tool motion as described below, the processor begins to look for an acceptable "fit" between the sensor log and the reference pattern. Once it has determined such a fit, based upon its calculated fit error function $\in$ being less than a threshold value $\in_0$, it determines the tool "velocity" along the reference pattern and the time to reach its destination D. Verifying its conclusions as it goes, the processor eventually determines that it is within an acceptably small distance $d_0$ to its detonation point, and activates the ignitor (42, FIG. 4).

Figure 11:
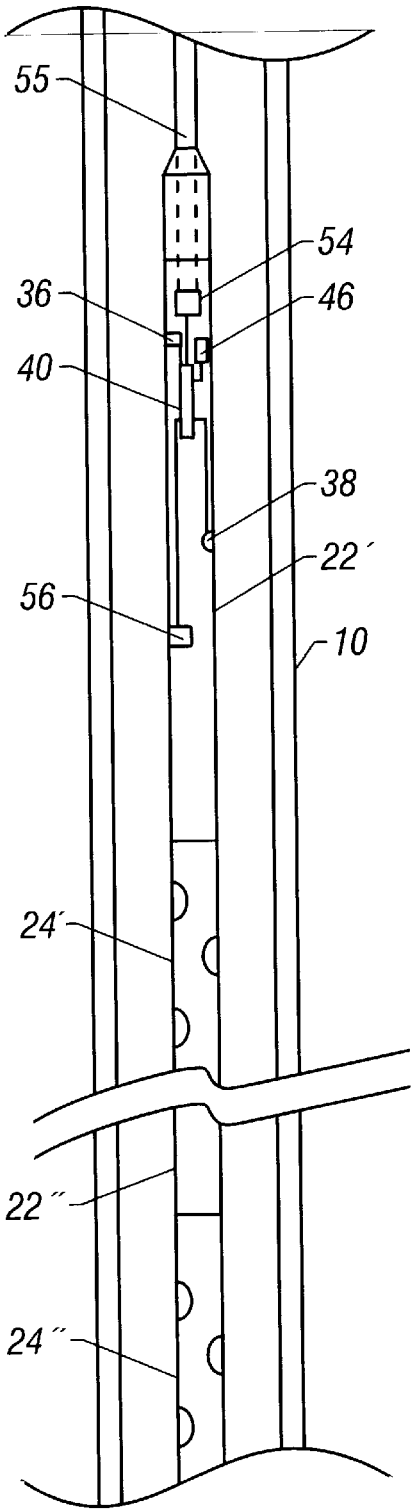
FIG. 11 illustrates a tool string with a first firing head having a detonation sensor to detect the detonation of a ballistic tool associated with a second firing head to initiate the correlation algorithm of the first firing head.

Any of the firing head configurations described above may be arranged in a tool string with other such firing heads to perform a series of downhole functions at different positions along the well. Referring to FIG. 11, for instance, a firing head 22' has a sensor 36 (of either type described above), and a processor 40 with memory 46. Firing head 22' is configured to detonate an associated gun 24'. In one configuration, firing head 22' has a pressure sensor 38 for sensing well pressure to initially activate the firing head to begin data processing as described above. In another configuration, it has instead a tubing pressure sensor 54 for sensing pressure in tubing 55 (in a tubing-conveyed arrangement) for so activating the firing head. In yet another tubing-conveyed case, the firing head has both a well pressure sensor 38 and a tubing pressure sensor 54, and initiates data processing at a predetermined difference between sensed tubing and well pressures.

Firing head 22' is also shown with a detonation sensor 56 (e.g., an accelerometer) for sensing the detonation of another gun 24" of the string. Gun 24" is arranged to be detonated by lower firing head 22", and the tool string has been configured to detonate gun 24" first, and then to detonate gun 24' at a subsequent point in time. Such an arrangement may be employed to perforate multiple zones within a single well, or to perforate a single position twice. For multiple-gun perforation of a single position along the well, for instance, a tool string may be configured with multiple firing heads each programmed to fire its associated gun at the same point along a common reference pattern. As such a tool string is moved along the well at a constant rate, each gun will automatically fire at the same depth in succession. In the tool string shown, the processor 40 of firing head 22' is adapted to not detonate tool 24' until it receives a signal from detonation sensor 56 that indicates that gun 24" has actually detonated. Thus, the detonation sensor performs a downhole gun sequencing check to keep from firing later guns if earlier ones have not performed as planned. This can avoid undesired perforation sequencing which can reduce the net recovery from the well.

In another embodiment, the upper firing head 22' is triggered by the detonation of lower gun 24" to begin data processing for depth correlation as the string is raised continuously along the well, or in a predetermined sequence of direction reversals. In this manner, multiple gun sections may be strung together for automatically perforating multiple levels within a well in a single trip, without input needed from the surface. The processor 40 in each firing head is preferably adapted to also store in retrievable memory pressure and temperature conditions before, after and during the firing of its associated gun, for later analysis. Thus, valuable data from perforations, pressure tests, fraccing and other downhole operations can be automatically recorded for later analysis after the string is retrieved from the well.

Figure 12:
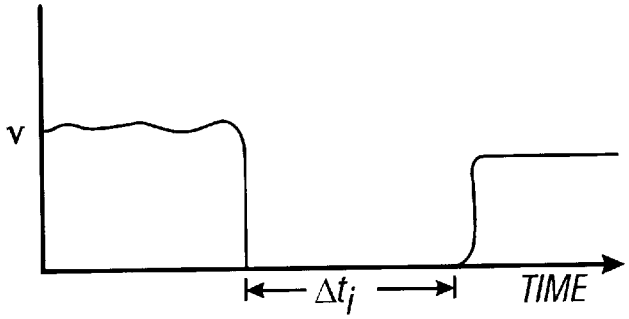
FIG. 12 is a time plot of tool velocity, illustrating employing a predetermined tool motion pattern to initiate depth correlation.

Other means of activating the firing head to begin data processing may also be employed. For instance, the firing head may be equipped with an accelerometer or other motion detector (not shown) and the processor adapted to begin processing when a predetermined pattern of tool motion is recognized. For example, FIG. 12 illustrates a time trace of tool velocity corresponding to lowering the tool string into the well and then holding the tool at a constant depth (i.e., with zero velocity) to initiate depth correlation. The processor is adapted to initiate its pattern recognition algorithm only when tool velocity, as determined from the tool motion sensor, has remained zero for a preprogrammed $\Delta t_i$ minutes. Other motion patterns may also be appropriate.

Figure 13:
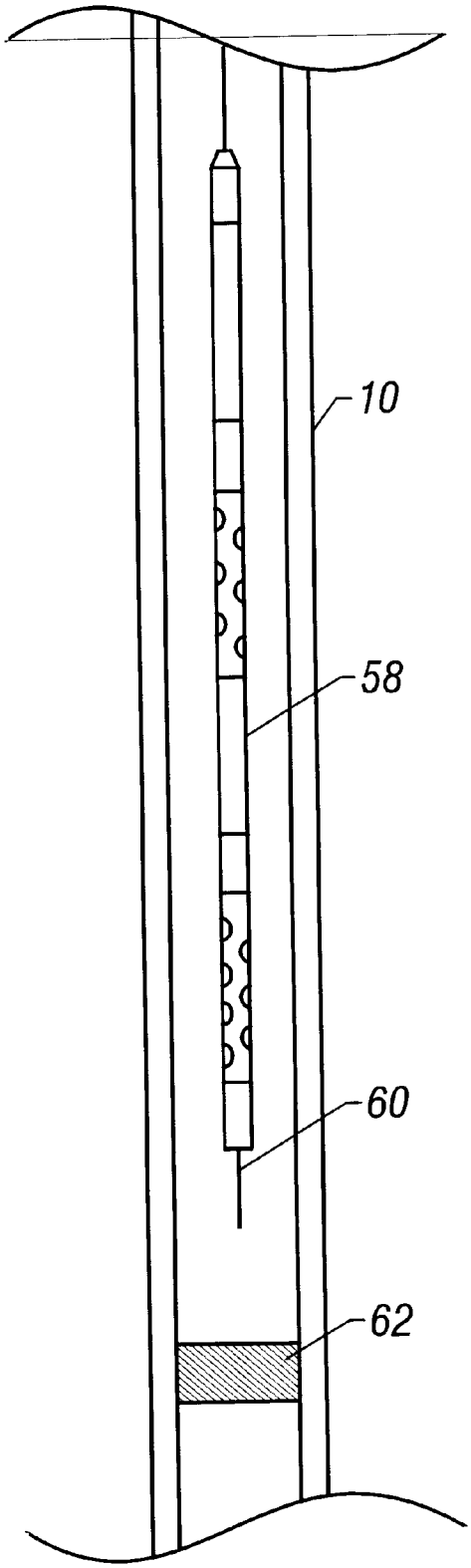
FIG. 13 shows a tool string with a trigger pin for initiating the depth correlation algorithm of the firing head when the pin engages a bridge plug.

Triggering may also be accomplished by contact between the tool string and another downhole object. For example, FIG. 13 shows a multiple firing head tool string 58 with a trigger pin 60 extending from its lower end. The tool string is lowered into the well until trigger pin 60 is depressed by a preset bridge plug 62, and then raised at a constant rate until it has automatically performed its series of functions. The bottom of the well may also serve as the downhole object for triggering the tool string.

Triggering the tool by manipulating tool velocity or tubing pressure may be said to involve transmitting a "signal" from the surface of the well, as they involve active participation by an uphole operator. Other examples of signals which may be transmitted from the well surface to initiate the processor include simple electric signals (such as the receipt of an elevated voltage on a single conductor, which may or may not provide power to the processor), hydraulic signals (such as a series of tubing or well pressure fluctuations), and acoustic signals transmitted through well fluids. In each illustrated case, however, once the downhole processor is initiated the timing and positioning of all tool functions is performed remotely, without subsequent input required from the operator.

Any of the firing heads described above may be arranged to activate guns or other types of tools, including but not limited to setting tools, packers, bridge plugs and valves. For instance, a multifunction string may be made up with a first firing head connected to a setting tool, and a second firing head connected to a perforating gun. The first firing head is as described above, and automatically activates the setting tool at a predetermined position along the well, thus temporarily fixing the position of the tool string along the well. The second firing head, not including any processor as described above, need only be adapted to fire its gun a predetermined length of time after the setting tool has activated. Alternately, the second firing head may include a processor and a pressure sensor for arming the firing head only upon successful completion of a packer pressure test. The first firing head may further be adapted to sense the detonation of the gun (e.g., with a detonation sensor as described above) and release the setting tool. Memory 46 and processor 40 of the first firing head are configured to record sensor signals (e.g., pressures and temperatures) before, during and after gun detonation, for later retrieval and analysis. The operator need only know to pause in the retrieval of the tool string when the cable or tubing tension indicates that the setting tool has activated, and to resume retrieval when the tension abates.

Although the above embodiments feature firing heads configured to initiate a ballistic detonation for activating an associated tool, it should be understood that the tool of the invention need not be a firing head in the traditional sense. The above-described automated control method and hardware may be employed to initiate any appropriate downhole function, including but not limited to opening valves, moving tool sections relative to one another, creating an effect on the well casing (such as perforation), or effecting the surrounding geology or well flow in any desired manner.

Other tool string and tool configurations and arrangements will be made obvious to those skilled in the art as a result of the above-described embodiments, and are also intended to be covered by the following claims.

What is claimed is:

1. A tool for initiating a downhole function in a subsurface well, the tool comprising memory adapted to store a well-specific reference pattern of a downhole well characteristic as a function of position along the well;

a sensor responsive to the downhole well characteristic; and a clocked processor adapted to receive a well characteristic signal from said sensor, determine, from said signal and the reference pattern in memory, the position of the tool along the well, and to automatically initiate a downhole function at a preprogrammed position along the well while the tool is moved at a substantially constant rate along the well.

2. The tool of claim 1 wherein the reference pattern comprises a sequence of irregular spacings between distinct downhole features, the sensor being responsive to the proximity of each of said features to the sensor.

3. The tool of claim 2 wherein the features comprise casing joints.

4. The tool of claim 2 wherein the features comprise casing magnetic property variations.

5. The tool of claim 2 wherein the processor is further adapted to determine the rate of motion of the tool along the well, and to initiate the downhole function at a preprogrammed position between adjacent features.

6. The tool of claim 2 comprising first and second said sensors, spaced apart along the tool by a fixed longitudinal distance, the clocked processor being adapted to receive signals from both first and second said sensors and to determine, from said signals and the reference pattern in memory, the position and velocity of the tool along the well.

7. The tool of claim 6 adapted for use in a cased well with a characteristic pattern of downhole features having an average spacing, the longitudinal distance between the first and second sensors of the tool being significantly less than the average spacing of the downhole features, the tool further comprising a third sensor responsive to the proximity of the downhole features and spaced from the first and second sensors by a fixed longitudinal distance approximately equal to the average spacing of the downhole features.

8. The tool of claim 6 wherein the tool comprises a housing in which the first and second sensors are mounted, the housing comprising a material having a thermal expansion coefficient of less than about 4 micrometer per meter-degree Kelvin at about 465 degrees Kelvin and extending along substantially the entire longitudinal distance between the sensors.

9. The tool of claim 6 wherein the tool comprises a housing in which the first and second sensors are mounted, the housing comprising a material which is essentially nonmagnetic, has a thermal expansion coefficient of less than about 15 micrometer per meter-degree Kelvin at about 465 degrees Kelvin, and extends along substantially the entire longitudinal distance between the sensors.

10. The tool of claim 6 wherein the tool comprises a housing in which the first and second sensors are mounted, the housing comprising a material extending along substantially the entire longitudinal distance between the sensors; and a temperature sensor mounted to be responsive to the temperature of the housing material; the processor adapted to automatically compensate for changes in the longitudinal distance between the two sensors caused by housing material temperature variations.

11. The tool of claim 1 wherein the reference pattern comprises geophysical log measurement data.

12. The tool of claim 11 wherein the processor is adapted to store a log of the signal received from the sensor, and to compare the signal log to the reference pattern to determine the position of the tool along the well.

13. The tool of claim 11 further comprising a casing joint sensor.

14. The tool of claim 1 further comprising a pressure sensor responsive to hydrostatic well pressure, the tool being adapted to enable said initiation in response to well pressure.

15. The tool of claim 14 adapted to disallow said initiation below a preset threshold pressure.

16. The tool of claim 14 adapted to enable said initiation upon sensing a predetermined sequence of well pressure conditions.

17. The tool of claim 1 adapted to be lowered into the well on tubing and comprising a first pressure sensor responsive to hydrostatic well pressure; and a second pressure sensor responsive to hydrostatic tubing pressure;

the tool being adapted to enable said initiation in response to a combined function of well and tubing pressures.

18. The tool of claim 17 adapted to disallow said initiation below a preset threshold difference between well and tubing pressures.

19. The tool of claim 17 adapted to enable said initiation upon sensing a predetermined sequence of relative variations in well and tubing pressures.

20. The tool of claim 1 adapted to be moved along the well on a slick line.

21. The tool of claim 1 further comprising a shot detector responsive to a ballistic detonation within the well, the tool being adapted to disallow said initiation until a ballistic detonation is detected by the shot detector.

22. The tool of claim 1 wherein the clocked processor is adapted to begin comparing said signal and reference pattern in response to a sensed downhole event.

23. The tool of claim 22 wherein the sensed downhole event comprises receipt of a signal transmitted from the surface of the well.

24. The tool of claim 23 wherein the signal transmitted from the surface of the well is of a type selected from the group consisting of hydraulic pressure, electric, and acoustic.

25. The tool of claim 22 wherein the sensed downhole event comprises maintaining the tool in a stationary downhole position for a predetermined length of time.

26. The tool of claim 22 wherein the sensed downhole event comprises the tool contacting a downhole well surface.

27. The tool of claim 22 wherein the sensed downhole event comprises a predetermined pattern of tool motions.

28. A method of initiating a downhole function in a subsurface well, the method comprising (1) lowering a tool into the well, the tool having
memory containing a well-specific reference pattern of a downhole well characteristic as a function of position along the well;
a sensor responsive to the downhole well characteristic; and
a clocked processor adapted to
receive a well characteristic signal from said sensor,
determine, from said signal and the reference pattern in memory, the position of the tool along the well, and to
automatically initiate a downhole function at a preprogrammed position along the well while the tool is moved at a substantially constant rate along the well; and (2) moving the tool at a substantially constant rate along the well until the clocked processor has determined the position of the tool along the well and automatically initiated the downhole function.

29. The method of claim 28 further comprising, prior to lowering the tool into the well, downloading the well-specific reference pattern into the tool memory.

30. The method of claim 28 wherein the reference pattern comprises a sequence of irregular spacings between distinct downhole features, the sensor being responsive to the proximity of each said feature.

31. The method of claim 30 wherein the subsurface well is cased and wherein the downhole features comprise casing collars, the method further comprising correlating the sequence of irregular spacings between casing collars to a well-specific log of geophysical measurement data; and downloading the sequence of spacings between casing collars into the tool memory.

32. The method of claim 28 wherein the reference pattern comprises geophysical log measurement data, and wherein the processor is adapted to store a log of the signal received from the sensor and to compare the signal log to the reference pattern to determine the position of the tool along the well.

33. The method of claim 28 wherein the clocked processor is adapted to begin comparing said signal and reference pattern in response to a sensed downhole event, the method further including, after lowering the tool into the well, causing the downhole event.

34. The method of claim 28 further comprising, after the downhole function has been initiated, retrieving the tool from the well and configuring the tool for a subsequent operation.

35. The method of claim 28 wherein the tool comprises first and second said sensors, spaced apart along the tool by a fixed longitudinal distance, the clocked processor being adapted to receive signals from both first and second said sensors and to determine, from said signals and the reference pattern in memory, the position and velocity of the tool along the well.

36. The method of claim 35 wherein the tool comprises a housing in which the first and second sensors are mounted, the housing comprising a material extending along substantially the entire longitudinal distance between the sensors; and a temperature sensor mounted to be responsive to the temperature of the housing material; the method including automatically compensating for changes in the longitudinal distance between the two sensors caused by housing material temperature variations.

* * * * *